US005458550A

United States Patent [19]

Braim et al.

[11] Patent Number: 5,458,550

[45] Date of Patent: Oct. 17, 1995

[54] SUSPENDABLE CHILD WALKER SYSTEM

[76] Inventors: Roger H. Braim; Terrie L. Braim, both of 380 Main St., Banks, Oreg. 97106

[21] Appl. No.: 219,080

[22] Filed: Mar. 28, 1994

[51] Int. Cl.[6] ..... A63B 22/00

[52] U.S. Cl. ..... 482/69; 297/DIG. 11; 297/274

[58] Field of Search ..... 422/69; 297/DIG. 11, 297/274, 275

[56] References Cited

U.S. PATENT DOCUMENTS

| | | | |
|---|---|---|---|
| 3,794,317 | 2/1974 | Barrett | 297/274 |
| 4,256,098 | 3/1981 | Swan et al. | 482/69 |
| 4,410,175 | 10/1983 | Shamp | 482/69 |
| 4,844,452 | 7/1989 | Tomosky et al. | 297/274 |
| 4,911,426 | 3/1990 | Scales | 482/69 |
| 4,948,118 | 8/1990 | Miraglia | 482/69 |
| 4,948,120 | 8/1990 | Krueger et al. | 297/274 |

*Primary Examiner*—Lynne A. Reichard

[57] ABSTRACT

A suspendable child walker system includes a slide bar coupled to an upper support surface and formed as a hollow generally rectangular box. The slide bar has a roof and a floor with vertical sidewalls. The roof and floor have parallel long sides and parallel short sides with circular apertures throughout. The floor also has a centrally located aperture extending the majority of the length of the slide bar. A roller assembly consists of cylindrically shaped axles each having a wheel attached to their opposite ends, and a generally tubular main body piece. The main body piece is positioned at right angles to the axles with the axles extending therethrough. The main body piece also includes a centrally located vertical aperture. A spring has a lower extent formed as a curved hook, and an upper extent with the spring between its upper extent and lower extent. The spring also includes a coupling device adapted to be mated with the upper extent of the spring through the centrally located aperture in the main body piece. A child seat includes apertures to permit attachment of releasable coupling devices therethrough. A support harness has an upper end and a lower end joined together by a coupling mechanism. The upper end consists of a single strap terminating in coupling devices. The lower end consists of a plurality of straps terminating in coupling devices and adapted to be coupled to the child seat.

6 Claims, 3 Drawing Sheets

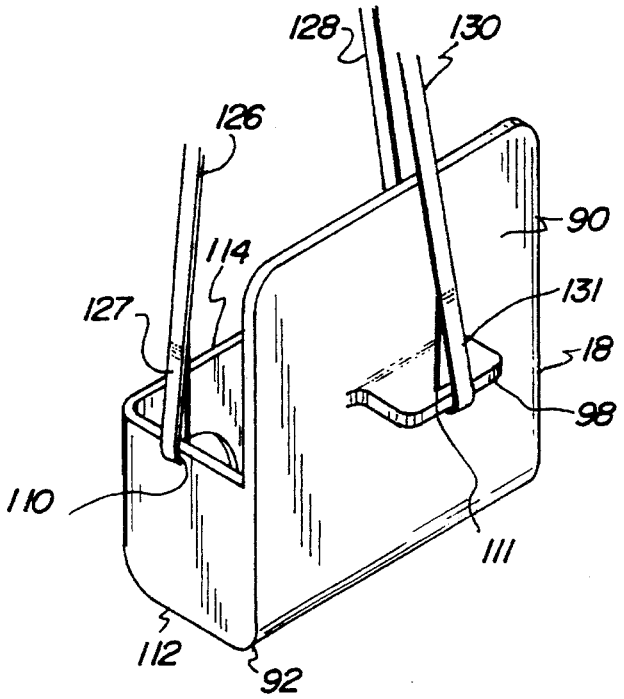
Fig. 5
Fig. 6
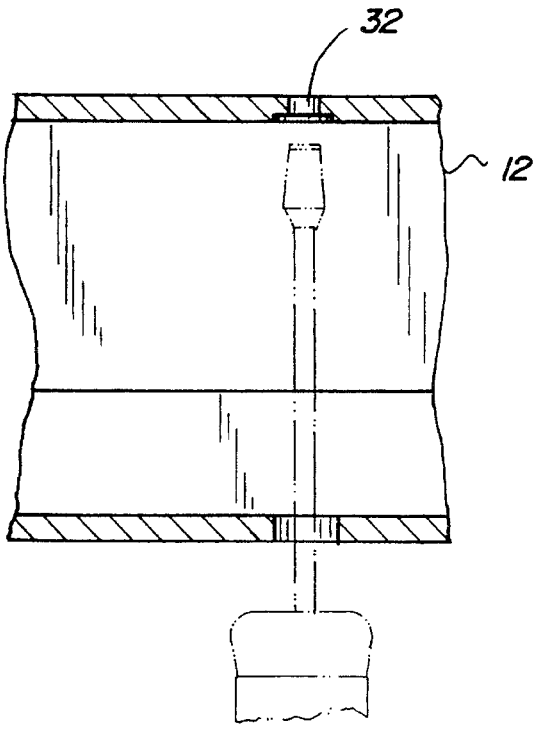

SUSPENDABLE CHILD WALKER SYSTEM

BACKGROUND OF THE INVENTION

1. Field of the Invention

The present invention relates to suspendable child walker systems and more particularly pertains to suspending child seats from a moveable roller assembly housed in a ceiling mounted slide bar.

2. Description of the Prior Art

The use of child walker devices is known in the prior art. More specifically, child walker devices heretofore devised and utilized for the purpose of entertaining children and assisting them in learning how to walk are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,844,452 to Tomosky et al., a self supporting infant jumper device.

U.S. Pat. No. 3,722,883 to O'Dowd discloses a child's swing.

U.S. Pat. No. 4,896,878 to Greenwood discloses a recreational device.

U.S. Pat. No. 3,721,437 to Skaricic discloses a walking trainer.

Lastly, U.S. Pat. No. Des. 332,671 to Borg discloses the ornamental design for a child walking training device.

In this respect, the suspendable child walker systems according to the present invention substantially departs from the conventional concepts and designs of the prior art, and in doing so provides an apparatus primarily developed for the purpose of suspending child seats from a moveable roller assembly housed in a ceiling mounted slide bar.

Therefore, it can be appreciated that there exists a continuing need for new and improved suspendable child walker systems which can be used for suspending child seats from a moveable roller assembly housed in a ceiling mounted slide bar. In this regard, the present invention substantially fulfills this need.

SUMMARY OF THE INVENTION

In view of the foregoing disadvantages inherent in the known types of child walker devices now present in the prior art, the present invention provides an improved suspendable child walker systems. As such, the general purpose of the present invention, which will be described subsequently in greater detail, is to provide a new and improved suspendable child walker systems and method which has all the advantages of the prior art and none of the disadvantages.

To attain this, the present invention essentially comprises a new and improved suspendable child walker system including a ceiling slide bar slide bar formed as a hollow, generally rectangular box. The slide bar has a roof and a floor with short vertical sidewalls connecting the roof and floor. The roof has parallel long sides and parallel short sides and includes a plurality of circular apertures throughout its extent. The floor has parallel long sides and parallel short sides and includes a plurality of circular apertures throughout its extent in vertical alignment with the apertures in the roof. The floor also has a centrally located rectangular aperture measuring about one third of the width of the slide bar and extends from one short side to the opposite short side. The remainder of the floor consists of two noncontiguous segments abutting the long side walls of the slide bar and measuring about one third of the width of the slide bar. The noncontiguous segments of the floor include short vertical walls at the ends opposite from the long side walls thereby defining the central aperture of the floor. A roller assembly consists of two cylindrically shaped axles. Each axle has a wheel attached to its opposite ends for rotational mobility of the roller assembly. The roller assembly also has a generally tubular main body piece. The main body piece is positioned at right angles to the axles with the axles extending through the main body piece proximate to its ends. The main body piece also includes a centrally located planar circular member with a vertical aperture therethrough. The aperture also includes a plurality of internal screw threads throughout its extent. A spring has an upper extent formed as a straight cylindrical member with a plurality of external screw threads. The spring has a lower extent formed as a curved hook. The spring has a plurality of circular coils between its upper extent and lower extent. A nut is cooperatively associated with the spring and adapted to be coupled to the upper extent of the spring through the circular member on the roller assembly. A child seat has a generally rectangular shaped back section with a curved lower portion and a front surface and a back surface. The back section has a planar, generally rectangular shaped member with an aperture therethrough extending perpendicularly from the approximate center point of the back surface of the back section. The child seat also has planar, generally rectangular front and side sections with rounded edges which measure about one half the vertical height of the back section. The front section includes two large circular holes at its lower extent to allow extension of a child's legs therethrough. The side sections include small slots at their upper extent. The child seat also includes a planar, generally rectangular bottom section and an open top section for placement of a child. A support harness has an upper end with a single strap terminating in a long fold over loop. A ring is coupled to the long fold over loop and removably received by the hook at the lower extent of the spring. The harness also has a lower end consisting of three straps terminating in short fold over loops. One of the short loops is connected to the aperture in the perpendicularly extending member on the back section of the child seat. Two of the short loops are connected to the slots in the sides of the child seat. The three straps are joined to the single strap of the upper end with a coupling mechanism located a short distance below the long fold over loop.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved suspendable child walker systems which have all the advantages of the prior art child walker devices and none of the disadvantages.

It is another object of the present invention to provide new and improved suspendable child walker systems which may be easily and efficiently manufactured and marketed.

It is further object of the present invention to provide new and improved suspendable child walker systems which are of durable and reliable constructions.

An even further object of the present invention is to provide new and improved suspendable child walker systems which are susceptible of a low cost of manufacture with regard to both materials and labor, and which accordingly are then susceptible of low prices of sale to the consuming public, thereby making such suspendable child walker systems economically available to the buying public.

Still yet another object of the present invention is to provide new and improved suspendable child walker systems which provide in the apparatuses and methods of the prior art some of the advantages thereof, while simultaneously overcoming some of the disadvantages normally associated therewith.

Still another object of the present invention is to suspend child seats from a moveable roller assembly housed in a ceiling mounted slide bar.

Lastly, it is an object of the present invention to provide new and improved suspendable child walker systems which include a slide bar coupled to an upper support surface and formed as a hollow generally rectangular box. The slide bar has a roof and a floor with vertical sidewalls. The roof and floor have parallel long sides and parallel short sides with circular apertures throughout. The floor also has a centrally located aperture extending the majority of the length of the slide bar. A roller assembly consists of cylindrically shaped axles each having a wheel attached to their opposite ends, and a generally tubular main body piece. The main body piece is positioned at right angles to the axles with the axles extending therethrough. The main body piece also includes a centrally located vertical aperture. A spring has a lower extent formed as a curved hook, and an upper extent. The spring includes a plurality of coils between its upper extent and lower extent. The spring also includes a coupling device adapted to be mated with the upper extent of the spring through the centrally located aperture in the main body piece of the roller assembly. A child seat includes apertures to permit attachment of releasable coupling means therethrough. A support harness has an upper end and a lower end joined together by a coupling mechanism. The upper end consists of a single strap terminating in coupling means. The lower end consists of a plurality of straps terminating in coupling means and adapted to be coupled to the child seat.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a perspective view of the child seat shown in FIG. 1.

FIG. 6 is a cross sectional view of the ceiling slide bar taken along line 6—6 of FIG. 3.

The same reference numerals refer to the same parts through the various Figures.

DESCRIPTION OF THE PREFERRED EMBODIMENT

Figure 1:
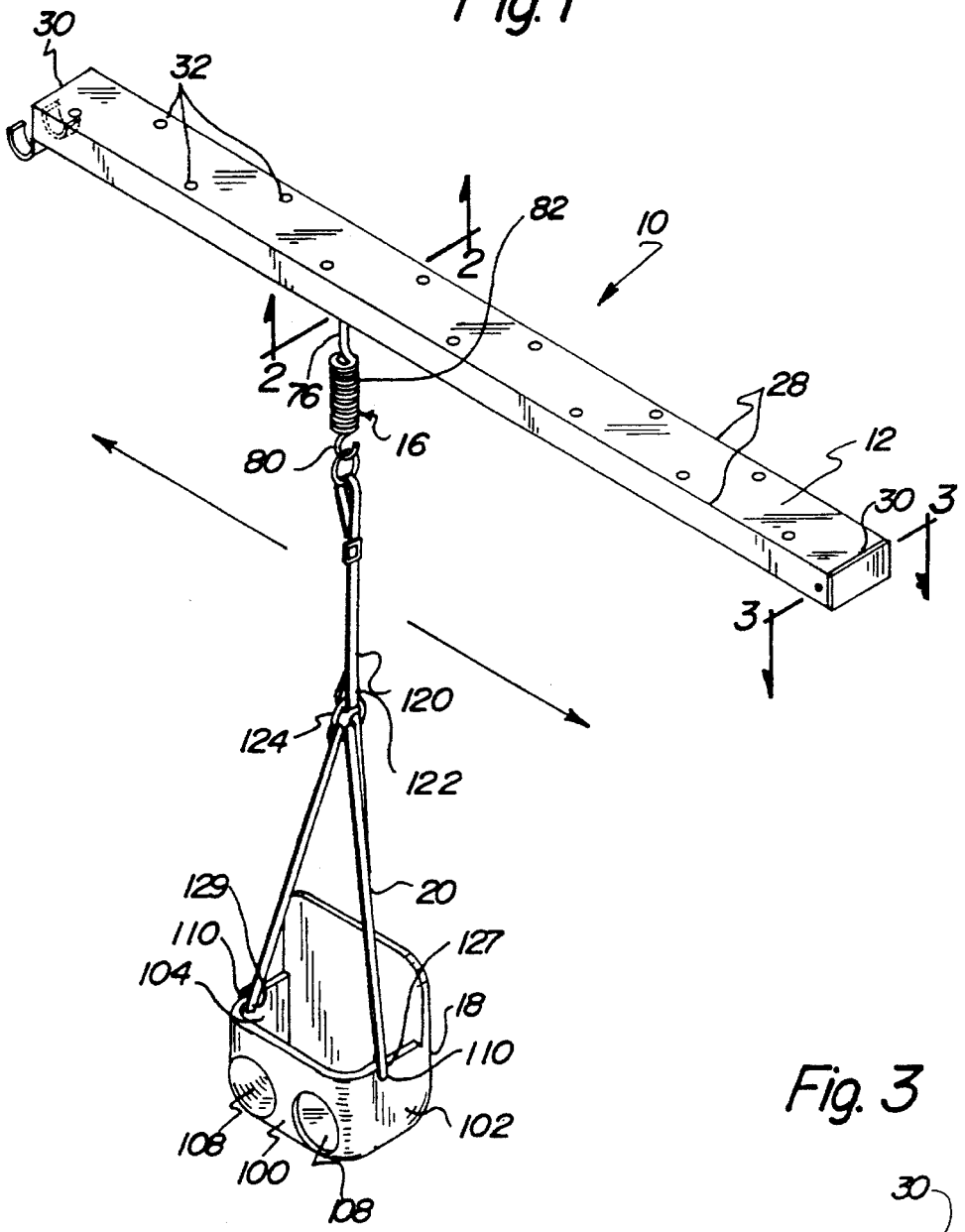
FIG. 1 is a perspective view of the preferred embodiment of the suspendable child walker systems constructed in accordance with the principles of the present invention.
Figure 3:
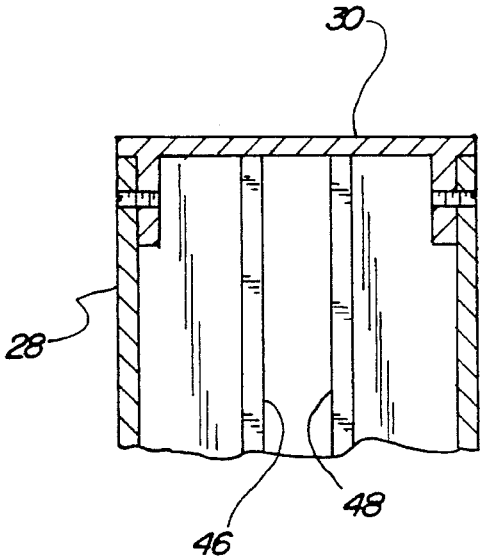
FIG. 3 is a broken away bottom plan view of the ceiling slide bar and roller assembly.
Figure 2:
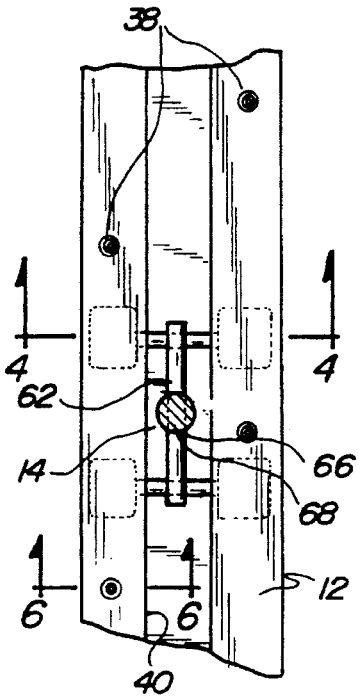
FIG. 2 is a broken away cross sectional view of the ceiling slide bar taken along line 2—2 of FIG. 1.
Figure 4:
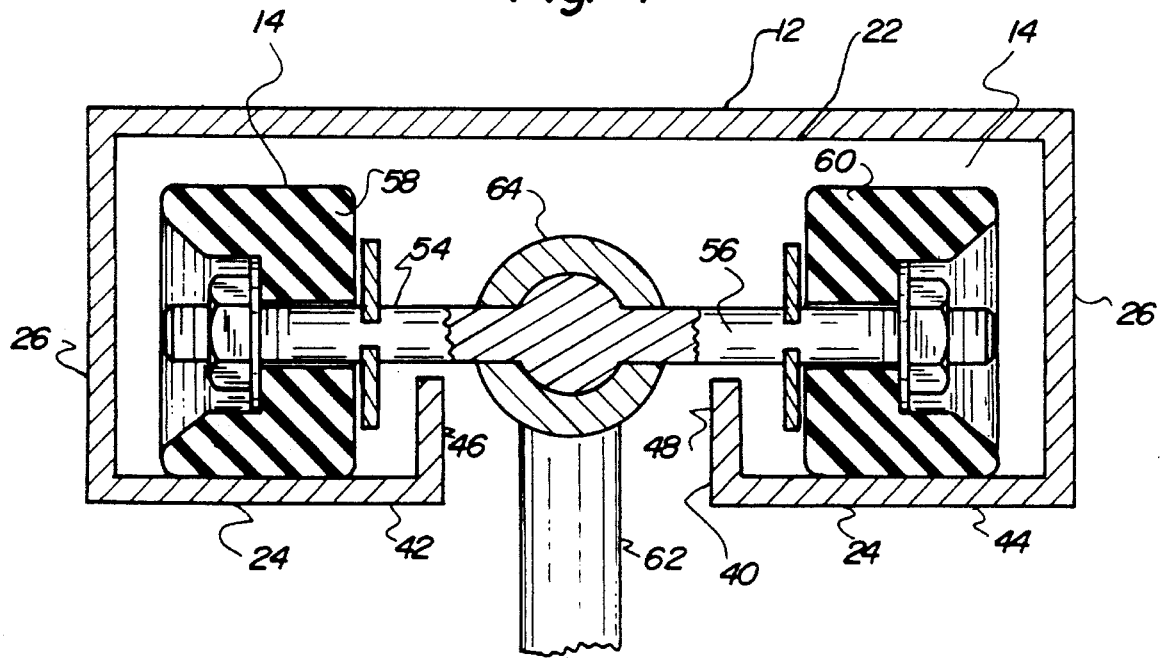
FIG. 4 is a cross sectional view of the slide bar and roller assembly taken along line 4—4 of FIG. 3.

With reference now to the drawings, and in particular to FIG. 1 thereof, the preferred embodiment of the new and improved suspendable child walker systems embodying the principles and concepts of the present invention and generally designated by the reference numeral 10 will be described.

Specifically, it will be noted in FIGS. 1 through 6, that there is provided a new and improved suspendable child walker system 10. The suspendable child walker system 10, in its broadest context, comprises a ceiling slide bar 12, a roller assembly 14, a spring 16, a child seat 18 and a support harness 20.

More specifically, the ceiling slide bar 12 is formed as a hollow, generally rectangular box. The slide bar has a roof 22 and a floor 24 with short vertical sidewalls 26 connecting the roof 22 and floor 24. The roof 22 and floor 24 have parallel long sides 28 and parallel short sides 30 and includes a plurality of circular apertures 32 throughout its extent. The floor also includes a plurality of circular apertures 38 throughout its extent in vertical alignment with the apertures 32 in the roof. The floor 24 also has a centrally located rectangular aperture 40 measuring about one third of the width of the slide bar 12 and extends from one short side to the opposite short side. The remainder of the floor 24 consists of two noncontiguous segments 42, 44 abutting the vertical side walls 26 of the slide bar and measuring about one third of the width of the slide bar 12. The noncontiguous segments 42, 44 of the floor include short vertical walls 46, 48 at the ends opposite from the vertical side walls thereby defining the central aperture 40 of the floor. The ceiling slide bar is adapted to be affixed to a sturdy upper support surface such as a ceiling beam.

A roller assembly 14 consists of two cylindrically shaped axles 54, 56. Each axle 54, 56 has a wheel 58, 60 attached to its opposite ends for rotational mobility of the roller assembly 14. The roller assembly 14 also has a generally tubular main body piece 62. The main body piece 62 is positioned at right angles to the axles 54, 56 with the axles extending through the main body piece 62 proximate to its ends. The main body piece 62 also includes a centrally located planar circular member 64 with a vertical aperture therethrough 66. The aperture 66 also includes a plurality of internal screw threads 68 throughout its extent. The roller assembly is adapted to roll in the slide bar from one side to the other. The four wheel construction of the roller assembly allows the child to move with a minimum of effort.

A spring 16 has an upper extent 76 formed as a straight cylindrical member with a plurality of external screw threads. The spring 16 has a lower extent 80 formed as a curved hook. The spring 16 has a plurality of circular coils 82 between its upper extent 76 and lower extent 80. The spring is adapted to be suspended from the circular member without interfering with the mobility of the roller.

A child seat 18 has a generally rectangular shaped back section 90 with a curved lower portion 92. The back section 90 has a planar, generally rectangular shaped member 98 with an aperture therethrough extending perpendicularly from the approximate center point of the back surface of the back section 90. The child seat 18 also has planar, generally rectangular front section 100 and side sections 102, 104 with rounded edges which measure about one half the vertical height of the back section 90. The front section 100 includes two large circular holes 108 at it lower extent to allow extension of a child's legs therethrough. The side sections 102, 104 include small slots 110, 111 at their upper extent. The child seat 18 also includes a planar, generally rectangular bottom section 112 and an open top section 114 for placement of a child. The seat is adapted to comfortably support children of varying ages.

A support harness 20 has an upper end with a single strap 120 terminating in a long fold over loop 122. A ring 124 is coupled to the long fold over loop 122 and removably received by the hook 80 at the lower extent of the spring. The harness 20 also has a lower end consisting of three straps 126, 128, 130 terminating in short fold over loops, 127, 129, 131. One of the short loops 129 is connected to the aperture in the perpendicularly extending member 98 on the back section of the child seat. Two of the short loops 127, 131 are connected to the slots 110, 111 in the sides of the child seat. The three straps 126, 128, 130 are joined to the single strap 120 of the upper end with a coupling mechanism 124 located a short distance below the long fold over loop 122. The lengths of the straps may be adjusted by manipulating the coupling mechanism joining the straps. The straps are comprised of sturdy materials to insure safe support of the child.

The suspendable child walker system is essentially a moveable jumper seat for infants and young children. The spring component allows a child to jump up and down while in the seat. The roller assembly in the ceiling slide bar permits a child to move five to six feet forward and back without risking injury from bumping into door jams or other potentially harmful obstacles. The apparatus therefore allows more mobility for the child by moving the child away from the doorway and into the living room. The apparatus also enhances the safety of the child by moving them out of door ways and other such areas inconvenient to adults.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved suspendable child walker system comprising, in combination:

a ceiling slide bar, the slide bar being formed as a hollow generally rectangular box with a roof and a floor and short vertical sidewalls connecting the roof and floor, the roof having parallel long sides and parallel short sides and including a plurality of circular apertures throughout its extent, the floor having parallel long sides and parallel short sides and including a plurality of circular apertures throughout its extent in vertical alignment with the apertures in the roof, the floor also having a centrally located rectangular aperture measuring about one third of the width of the slide bar and extending from one short side to the opposite short side with the remainder of the floor consisting of two noncontiguous segments abutting the long side walls of the slide bar and measuring about one third of the width of the slide bar, the noncontiguous segments of the floor including short vertical walls at the ends opposite from the long side walls thereby defining the central aperture of the floor;

a roller assembly, the roller assembly consisting of two cylindrically shaped axles, each axle having a wheel attached to its opposite ends for rotational mobility of the roller assembly, the roller assembly also having a generally tubular main body piece, the main body piece being positioned at right angles to the axles with the axles extending through the main body piece proximate to its ends, the main body piece also including a centrally located planar circular member with a vertical aperture therethrough, the aperture also including a plurality of internal screw threads throughout its extent;

a spring, the spring having an upper extent formed as a straight cylindrical member and including a plurality of external screw threads, the spring having a lower extent formed as a curved hook, with the spring having a plurality of circular coils between its upper extent and lower extent, a nut cooperatively associated with the spring and adapted to be coupled to the upper extent of the spring through the circular member on the roller assembly;

a child seat, the child seat having a generally rectangular shaped back section with a curved lower portion and a front surface and a back surface, the back section having a planar generally rectangular shaped member with an aperture therethrough extending perpendicularly from the approximate center point of the back surface of the back section, the child seat also having planar generally rectangular front and side sections with rounded edges and measuring about one half the vertical height of the back section, the front section including two large circular holes at its lower extent to allow extension of a child's legs therethrough, the side sections including small slots at their upper extent, the child seat also including a planar generally rectangular bottom section and an open top section for placement of a child; and a support harness, the harness having an upper end with a single strap terminating in a long fold over loop, with a ring coupled to the long fold over loop and removably received by the hook at the lower extent of the spring, the harness also having a lower end consisting of three straps terminating in short fold over loops, with one of the short loops being connected to the aperture in the perpendicularly extending member on the back section of the child seat, with two of the short loops being connected to the slots in the sides of the child seat, the three straps being joined to the single strap of the upper end with a coupling mechanism located a short distance below the long fold over loop.

2. A suspendable child walker system comprising:

a slide bar coupled to an upper support surface and formed as a hollow generally rectangular box with a roof and a floor and vertical sidewalls connecting the roof and floor, the roof and floor having parallel long sides and parallel short sides and circular apertures throughout, the floor also having a centrally located aperture extending the majority of the length of the slide bar;

a roller assembly consisting of cylindrically shaped axles each having a wheel attached to its opposite ends, the roller assembly also having a generally tubular main body piece, the main body piece being positioned at right angles to the axles with the axles extending through the main body piece, the main body piece also including a centrally located vertical aperture therethrough;

a spring having an upper extent and a lower extent, the lower extent being formed as a curved hook, with the spring including a plurality of coils between its upper extent and lower extent, the spring also including a coupling device adapted to be mated with the upper extent of the spring through the centrally located aperture in the main body piece of the roller assembly;

a child seat having apertures to permit attachment of releasable coupling means therethrough; and a support harness, the harness having an upper end and a lower end, the upper end consisting of a single strap terminating in coupling means, the lower end consisting of a plurality of straps terminating in coupling means and adapted to be coupled to the child seat, the upper end and lower end being joined together with a coupling mechanism located near the mid point of the support harness.

3. The child walker system as set forth in claim 2 and further including:

a plurality of apertures in the floor of the slide bar large enough to allow passage of a screw driver for the purpose of securing the roof to an upper mounting surface.

4. The child walker system as set forth in claim 2 and further including:

generally circular shaped rollers and a track, the rollers located in the track for movement therein, the track being positioned on the upper surface of the floor of the slide bar and including upwardly extending vertical sidewalls along the edges of the centrally located aperture in the floor.

5. The child walker system as set forth in claim 2 and further including:

a spring having an upper extent which includes a plurality of external screw threads.

6. The child walker system as set forth in claim 2 wherein the seat has a generally rectangular shaped back section with an aperture located near its upper extent, the child seat also having planar generally rectangular front and side sections with apertures located near their upper extents, the front section including two large holes near its lower extent to allow extension of a child's legs therethrough, the child seat also including a planar generally rectangular bottom section and an open top section for placement of a child.

* * * * *